US005123230A

United States Patent [19]

Upmann

[11] Patent Number: 5,123,230

[45] Date of Patent: Jun. 23, 1992

[54] METHOD AND APPARATUS FOR WRAPPING ARTICLES IN PLASTIC

[75] Inventor: Hubert Upmann, Steinfurt, Fed. Rep. of Germany

[73] Assignee: B. Hagemann Gmbh & Co., Steinfurt, Fed. Rep. of Germany

[21] Appl. No.: 629,867

[22] Filed: Dec. 19, 1990

[30] Foreign Application Priority Data

Dec. 19, 1989 [DE] Fed. Rep. of Germany ..... 3941940

[51] Int. Cl.[5] ..... B65B 11/02

[52] U.S. Cl. ..... 53/465; 53/218; 53/441; 53/504; 53/588

[58] Field of Search ..... 53/465, 441, 504, 556, 53/588, 214, 210, 218

[56] References Cited

U.S. PATENT DOCUMENTS

| | | | |
|---|---|---|---|
| 4,722,170 | 2/1988 | Ball et al. | 53/588 X |
| 4,862,678 | 9/1989 | Humphrey | 53/556 |
| 4,936,080 | 6/1990 | Haloila | 53/218 X |
| 4,953,336 | 9/1990 | Lancaster, III et al. | 53/556 |
| 5,005,335 | 4/1991 | Yourgalite et al. | 53/441 X |

FOREIGN PATENT DOCUMENTS

| | | | |
|---|---|---|---|
| 2126187 | 3/1984 | United Kingdom | 53/588 |

*Primary Examiner*—James F. Coan
*Attorney, Agent, or Firm*—Sprung Horn Kramer & Woods

[57] ABSTRACT

A method of wrapping articles in plastic, whereby the cross-section of the article dictates variations in the length of plastic web required at various times, with a mechanical wrapper that revolves around the article and has at least one take-off cylinder rotating at a rate controlled in accordance with a sequence of values that depends on the article's cross-section, and releasing plastic in the length required at a particular time. The sequence of values exploited for controlling the take-off cylinder (7) is determined during at least the first revolution of the winder (5) by measuring the stress on the web downstream of the take-off cylinder in the accordance with the angle (Φ) of the winder, is stored in a memory (15), and is appropriately standardized for varying the rate of rotation of the take-off cylinder. The device for carrying out the method has a tension sensor (9 & 10) that rests against the web (3) downstream of the take-off cylinder (7) and employs signal converters to determine the tension occurring as the take-off cylinder rotates in the form of a sequence of values depending on the angle Φ of rotation.

6 Claims, 2 Drawing Sheets

METHOD AND APPARATUS FOR WRAPPING ARTICLES IN PLASTIC

BACKGROUND OF THE INVENTION

The present invention concerns a method and apparatus for wrapping articles in plastic, whereby the cross-section of the article dictates variations in the length of plastic web required at various times, with a mechanical wrapper that revolves around the article and has at least one take-off cylinder rotating at a rate controlled in accordance with a sequence of values that depends on the article's cross-section, and releasing plastic in the length required at a particular time. The invention also concerns a device for carrying out the aforesaid method.

A device and method of the aforesaid type are known from the British patent publication No GB-OS 2 154 536. The controls that govern the rotating cylinder are not in communication with the web of plastic. They include means of constructing a model that essentially approximates the article's cross-section. The model is then employed to control the speed of the take-off cylinder. The controls are accordingly independent both of empirically detectable variations in the tension on the web and of empirically detected variations in the rate of demand. The model is a mechanically derived idealized demand that maintains the difference between the prescribed rate of supply and the momentary rate of demand as constant as possible. One drawback to the known device is that the "model," which essentially comprises several cylinders that can be shifted along one race, is very difficult to define and must be dealt with almost as a transformation of the cross-section of the article being wrapped. Furthermore, the model provides a strictly idealized structure in that the number of model parameters and hence the sequence of values being addressed can assume only a very limited number of variables.

A mechanical stretch wrapper is known from German patent publication No. DE-OS 2 750 780. It is used for wrapping articles on pallets. A strip of plastic is looped around a deflection cylinder between the supply roll and the palette. The deflection cylinder is subjected to an adjustable but constant force. When the deflection cylinder is diverted out of a middle position by increased tension on the web, controls (which involve a pressure-control valve or potentiometer for example) decrease the braking moment more or less in proportion with the angle of diversion.

This known paletted-article wrapper, however, cannot be directly employed for wrapping an article in plastic when the article's cross-section dictates variations in the length of plastic web required at various times.

SUMMARY OF THE INVENTION

The object of the present invention is accordingly to completely modify the aforesaid method to allow simpler, more rapid, and more reliable determination of the sequence of values than can be attained with a mechanical model. The invention is in fact actually intended to eliminate the need for a mechanical model.

This object, as well as other objects which will become apparent in the discussion that follows, are achieved, in accordance with the present invention in a method of the aforesaid type, wherein the sequence of values exploited for controlling the take-off cylinder is determined during at least the first revolution of the winder by measuring the stress on the web downstream of the take-off cylinder in accordance with the angle of the winder, is stored in a memory, and is appropriately standardized for varying the rate of rotation of the take-off cylinder.

The aforesaid method is generally initiated in that the winder rotates more slowly while the sequence of values is being determined than it does during the subsequent phases of the operation.

The sequence of values can be determined with a tension sensor for example. The speed to be attained is directly proportional to the tension detected at any point along the orbit. The tension is of course no longer detected during the rest of the operation, and the tension sensor or transducer is disengaged. Although the method is usually digital, it uses so many increments—$2^{10}$ per 360° for example—that control is practically continuous. Its main advantage of course is how rapidly the cross-section of the article being wrapped can be sensed.

The articles being wrapped are usually advanced by the winder's revolution, and the cross-section of an article can vary along the length it advances. If desirable, accordingly, a detection revolution can be interposed every 5, 20, or any desired number n revolutions to obtain a new sequence of values that can then be employed for the next 5 (for example) to n revolutions.

It is also essential that the aforesaid method consumes plastic both slowly and efficiently. A mechanical stretcher can be positioned upstream of and include the take-off cylinder. This system requires two cylinders that rotate at different speeds with the web traveling around both. The controls make this feature also easy to incorporate in that they allow the two cylinders to rotate at precisely the necessary ratio.

The device is otherwise similar to known wrappers.

The preferred embodiment of the present invention will now be described with reference to the accompanying drawings.

DESCRIPTION OF THE PREFERRED EMBODIMENT

Figure 1:
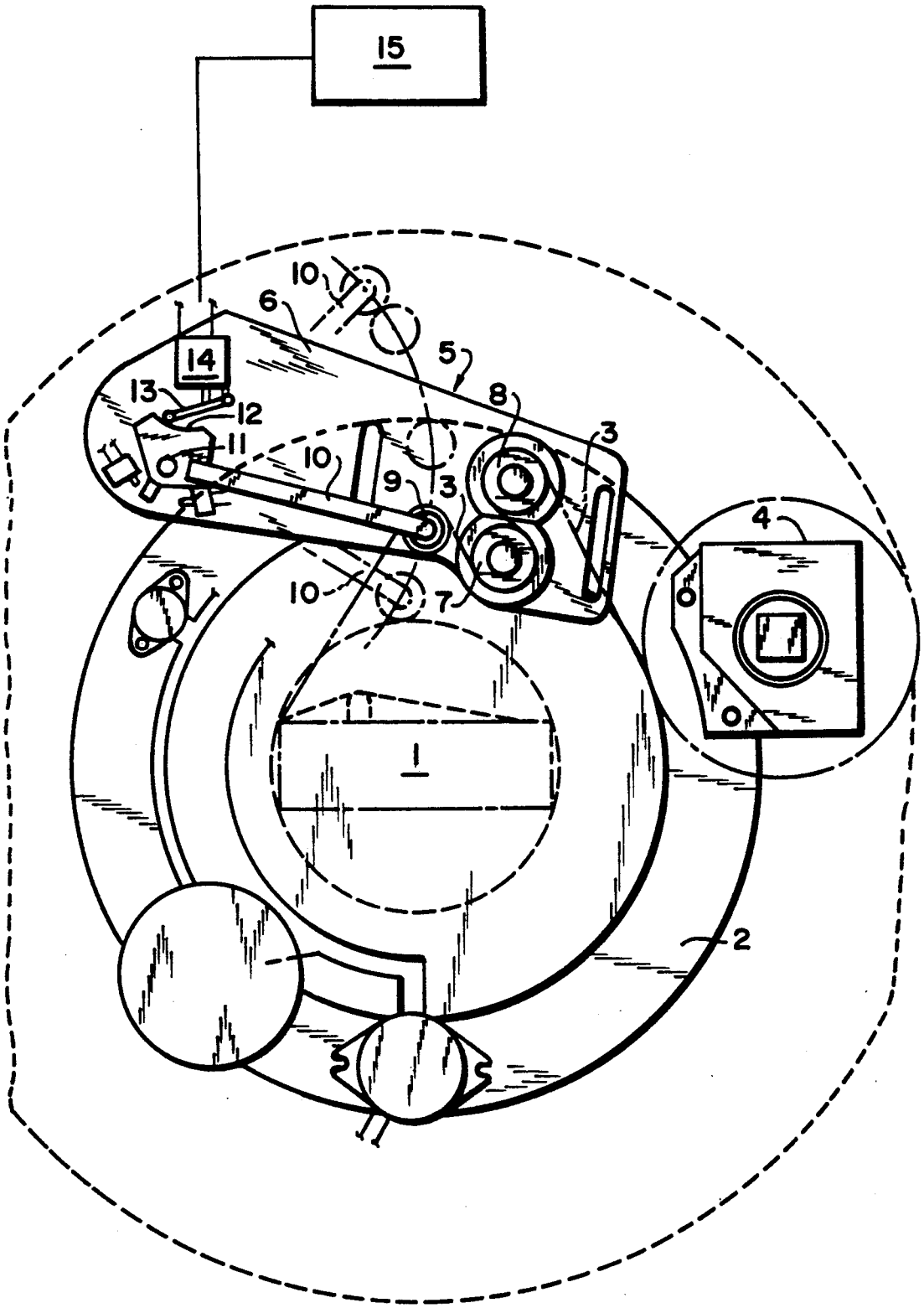
FIG. 1 is a schematic view of the revolving components of a device for carrying out the method.

FIG. 1 is a top view of a device for wrapping articles 1 in plastic in accordance with the present invention. The device has a race 2 for extracting a web 3 of plastic from a supply roll 4. The supply roll 4 travels along a race 2 accompanied by a wrapper 5. The wrapper 5 consists of a base 6 with two cylinders—specifically a take-off cylinder 7 and an intake cylinder 8. The cylinders are driven by an unillustrated transmission at different speeds in a prescribed ratio. The web 3 travels around intake cylinder 8, through an S-shaped loop, and around take-off cylinder 7. The cylinders are usually powered by hydraulic or electric motors that can be controlled from outside. The web 3 then travels over a cylinder 9 that detects the tension on web 3.

The wrapper travels conventionally along with the supply cylinder along race the 2. Mechanisms of this type are known from the state of the art as cited herein.

The method according to the invention proceeds as follows:

The wrapper initially revolves slowly, at 1/10 of a revolution per second for example, while a sequence of values corresponding to the cross-section of article 1 is established by laying the web of plastic against the article. Tension-sensing cylinder 9 is applied to the plastic and secured at a prescribed midpoint. Tension-sensing cylinder 9 is connected to a sensing arm 10 that pivots around a point 11 on base 6 and operates in conjunction with a cam 12. Another sensing arm 13 detects and enters the position of sensing arm 10 or tension-sensing cylinder 9 in a displacement memory 14. The higher the tension on web 3, the less tension will be applied to it by tension-sensing cylinder 9 and the less the displacement stored in memory 14 will be. The tension can accordingly be detected in just one revolution from the particular angle $\Theta$.

Figure 2:
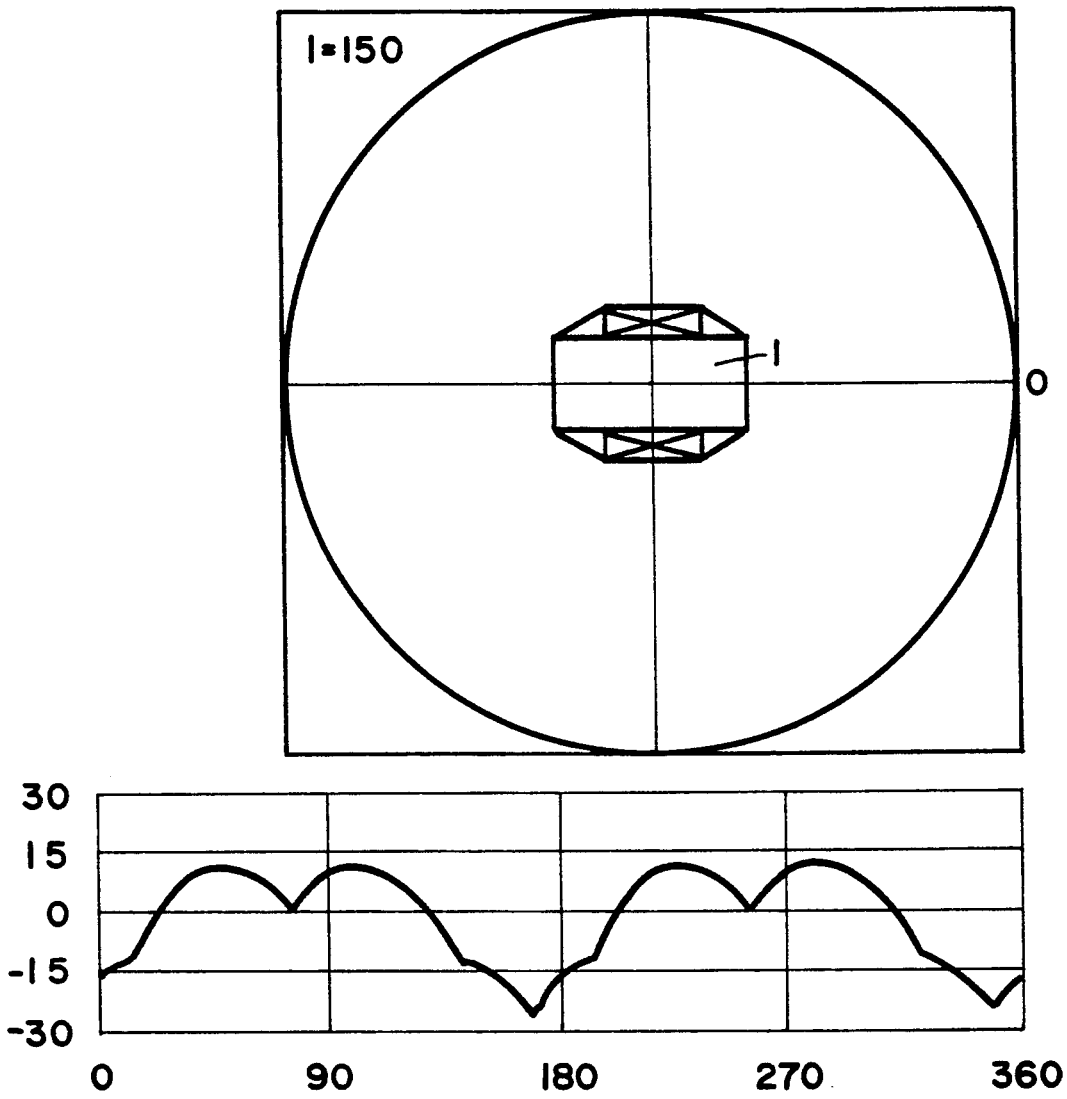
FIG. 2 illustrates an article of a particular shape to be wrapped along with the requisite percentual advance increment Γ.

A graph of this type is at the bottom of FIG. 2. The result is a sequence of 1024 for example values obtained during one revolution. This sequence is stored in an electronic memory. The wrapper 5 now accelerates, and the race advances article 1. The values, standardized by the aforesaid electronic memory, are then employed to control the speed at which take-off cylinder 7 rotates. As initially asserted herein, the percentual increment $\Gamma$ in the advance of take-off cylinder 7 depends on a mean speed directly proportional to the alterations in tension obtained during the first "trial run." Immediately after the first revolution, sensing arm 10 is out of contact with web 3 and into position E. It is, however, also possible for arm 10 to remain in contact and be exploited to detect such unexpected alterations or major errors as rips in the web or excessive tension due to the migration of article 1 away from the coordinate intersection illustrated in FIG. 2. What is essential is for the speed at which take-off cylinder 7 rotates to conform to the sequence of values and vary in very small increments, ensuring that the tension on the web will be precisely maintained. Even very irregular cross-sections, a container with the neck of a bottle projecting out of it as illustrated in FIG. 1 for example, can be detected.

It is also possible to initiate a new sequence of values with the initial section of each fresh article or at the midpoint of longer articles and use it as a point of departure for subsequent winding revolutions. It is accordingly also possible in accordance with the instant method to handle articles that are not positioned precisely at the origin of a set of intersecting coordinates because each sequence of values is determined independent of any centered article contour.

The drawing represents a data memory 15 only schematically. Such memories are of course known from electronic data processing. It is, however, also possible for the memory to resemble a punched tape or similar structure for example. Also essential is that take-off cylinder 7 and intake cylinder 8 are coupled in such a way as to rotate at a constant ratio and accordingly stretch the plastic out straight between them. Stretching mechanisms of this type are known and can be advantageously integrated into a device of the aforesaid genus.

The particular speeds of rotation depend on the nature and quality of the plastic in web 3. Such parameters as modulus of elasticity, stretching capacity, force of recuperation, etc. are precisely known and can be converted in a few attempts into a curve $\Gamma = f(\Phi)$ of dependent variables for use with the method in accordance with the invention.

The method can also be modified to advantage by entering article dimensions obtained from previous measurements for example into the controls by way of a keyboard for example, subsequent to which the sequence of values needed to control take-off cylinder 7 is calculated by the controls and stored in a memory for later use. Such dimensions can also be obtained for example by remote sensors.

There has thus been shown and described a novel method and apparatus for wrapping articles in plastic which fulfills all the objects and advantages sought therefor. Many changes, modifications, variations and other uses and applications of the subject invention will, however, become apparent to those skilled in the art after considering this specification and the accompanying drawings which disclose the preferred embodiment thereof. All such changes, modifications, variations and other uses and applications which do not depart from the spirit and scope of the invention are deemed to be covered by the invention, which is to be limited only by the claims which follow.

What is claimed is:

1. A method of wrapping an article in a plastic web using a mechanical winder operative to revolve around the article and having a rotatable plastic web take-off cylinder that released the length of plastic web required at each particular instant in accordance with the cross-section of the article as the winder revolves, said method comprising the steps of:

(a) revolving the winder around the article;

(b) measuring the tension on the plastic web downstream of the take-off cylinder in dependence upon the angle of revolution of the winder;

(c) determining from said tension measurement a sequence of values for controlling the rate of rotation of the take-off cylinder during at least the first revolution of the winder;

(d) storing said sequence of values in memory; and (e) varying the rate of rotation of the take-off cylinder during further revolutions of the winder in accordance with said sequence of values.

2. The method defined in claim 1, comprising the steps of rotating the winder more slowly while the sequence of values is being determined than during the subsequent phases of the operation.

3. A mechanical winding device for wrapping an article in a plastic web, said winding device being operative to revolve around the article and comprising:

(a) a rotatable plastic web take-off cylinder that releases the length of plastic web required at each particular instant in accordance with the cross-section of the article as the winding device revolves;

(b) means for generating a sequence of values for controlling the rate of rotation of the take-off cylinder;

(c) tension sensor means, arranged to rest against the plastic web downstream of the take-off cylinder, for determining the tension of the web as the take-off cylinder rotates to produce a sequence of values in dependence upon the angle of revolution of the winding device;

(d) a data memory, coupled to the tension sensor means, for storing the sequence of values and producing standardized signals that control the rate of rotation of the take-off cylinder during further revolutions of the winding device.

4. The device defined in claim 3, wherein article dimensions obtained from previous measurements are entered into the controls, subsequent to which the sequence of values needed to control the take-off cylinder is calculated by the controls and stored in a memory for later use.

5. The device defined in claim 3, wherein the dimensions are obtained by known remote sensors.

6. The device defined in claim 3, further comprising means for withdrawing the tension sensor from contact with the web.

* * * * *